US011512831B2

(12) United States Patent
Deng

(10) Patent No.: US 11,512,831 B2
(45) Date of Patent: Nov. 29, 2022

(54) HEATING UNIT FOR LIGHT SOURCES, INSTALLATION AND CONTROL SYSTEM THEREOF

(71) Applicant: Yi Deng, Foshan (CN)

(72) Inventor: Yi Deng, Foshan (CN)

( * ) Notice: Subject to any disclaimer, the term of this patent is extended or adjusted under 35 U.S.C. 154(b) by 0 days.

(21) Appl. No.: 16/968,858

(22) PCT Filed: Dec. 4, 2019

(86) PCT No.: PCT/CN2019/122842
§ 371 (c)(1),
(2) Date: Aug. 10, 2020

(87) PCT Pub. No.: WO2020/114408
PCT Pub. Date: Jun. 11, 2020

(65) Prior Publication Data

US 2021/0302006 A1 Sep. 30, 2021

Related U.S. Application Data

(60) Provisional application No. 62/775,856, filed on Dec. 5, 2018.

(51) Int. Cl.
*F21S 45/60* (2018.01)
*H01R 4/48* (2006.01)
*H05B 3/00* (2006.01)

(52) U.S. Cl.
CPC ..... *F21S 45/60* (2018.01); *H01R 4/4863* (2013.01); *H05B 3/009* (2013.01)

(58) Field of Classification Search
CPC ..... F21S 45/60
See application file for complete search history.

(56) References Cited

U.S. PATENT DOCUMENTS

2016/0363286 A1* 12/2016 Deering ..... F21S 43/14
2017/0175971 A1 6/2017 Tai
2019/0242547 A1 8/2019 Zhang
(Continued)

FOREIGN PATENT DOCUMENTS

CN 206120788 U 4/2017
CN 207213937 U 4/2018
CN 108317482 7/2018
(Continued)

OTHER PUBLICATIONS

PCT/2019CN/122842/International Search Report and Written Opinion.

*Primary Examiner* — Sean P Gramling
(74) *Attorney, Agent, or Firm* — NZ Carr Law Office

(57) ABSTRACT

The present disclosure relates to apparatus and methods for heating a lens for a light source. More particularly, the present disclosure relates to a heating unit for use in a vehicle light, methods of installation and control systems for the heating unit. For example, a heating unit according to the present disclosure includes a connector configured to maintain an electronic connection between a heating element and a control circuit by a bias force, such as a spring force. Instead of forming a fixed attachment with the heating element, the connector is pushed against the heating element to maintain connection therebetween. The non-fixed contact to the heater provides reliability, flexibility and simplicity to the heating unit.

20 Claims, 8 Drawing Sheets

(56) References Cited

U.S. PATENT DOCUMENTS

2020/0056756 A1* 2/2020 Kim ..... F21S 41/336

FOREIGN PATENT DOCUMENTS

| | | |
|---|---|---|
| CN | 207674355 U | 7/2018 |
| DE | 102012006678 | 9/2012 |
| FR | 3066350 | 11/2018 |
| JP | 2008052919 | 3/2008 |

* cited by examiner

HEATING UNIT FOR LIGHT SOURCES, INSTALLATION AND CONTROL SYSTEM THEREOF

FIELD

The present disclosure relates apparatus and methods for heating a lens for a light source. More particularly, the present disclosure relates to heating units for use in light sources, such as headlights for vehicles, methods of installation and control systems for the heating units.

BACKGROUND

Light sources, such as halogen lamps, xenon lamps, light emitting diode (LED) lights, or laser lights, are typically disposed within a housing and behind a lens to achieve the desired lighting effect. Many light sources, such as lights for vehicles, need to operate in all kind of weather conditions, such as cold and icy conditions. When operating in cold conditions, ice may form on the surface of the lens altering the optical property of the lens. This is problematic especially for low heat radiating light sources, such as LED lights.

Therefore, there is a need for apparatus and methods for heating lenses for light sources.

SUMMARY

The present disclosure includes apparatus and methods for heating lenses of light sources.

Embodiments of the present disclosure provide a heating unit for a light assembly. The light assembly includes a heating element attached to a transparent window and configured to heat the transparent window, a controller configured to provide electrical power to the heating element, and a connector having a first end in contact with the heating element and a second end in connection with the controller, wherein the first end contacts the heating element under a pre-loaded force.

Some embodiments of the present disclosure provide a heating unit for a light assembly. The heating unit includes a heating element attached to a transparent window and configured to heat the transparent window, a controller configured to provide electrical power to the heating element, and a temperature sensor connected to the controller, wherein the temperature sensor is positioned adjacent to the transparent window but not in contact with the transparent window to measure induction temperature of the transparent window.

Some embodiments of the present disclosure provide a vehicle headlight assembly. The vehicle headlight assembly includes a housing defining an inner volume and having an opening, a transparent window disposed in the opening, a heating unit disposed in the inner volume, wherein the heating unit comprises a heating element attached to the transparent window, a controller configured to provide electrical power to the heating element, and a connector disposed between the controller and the heating element, wherein the connector contacts the heating element by a non-fixed connection.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. It is to be noted, however, that the appended drawings illustrate only typical embodiments of this disclosure and are therefore not to be considered limiting of its scope, for the disclosure may admit to other equally effective embodiments.

Figure 1:
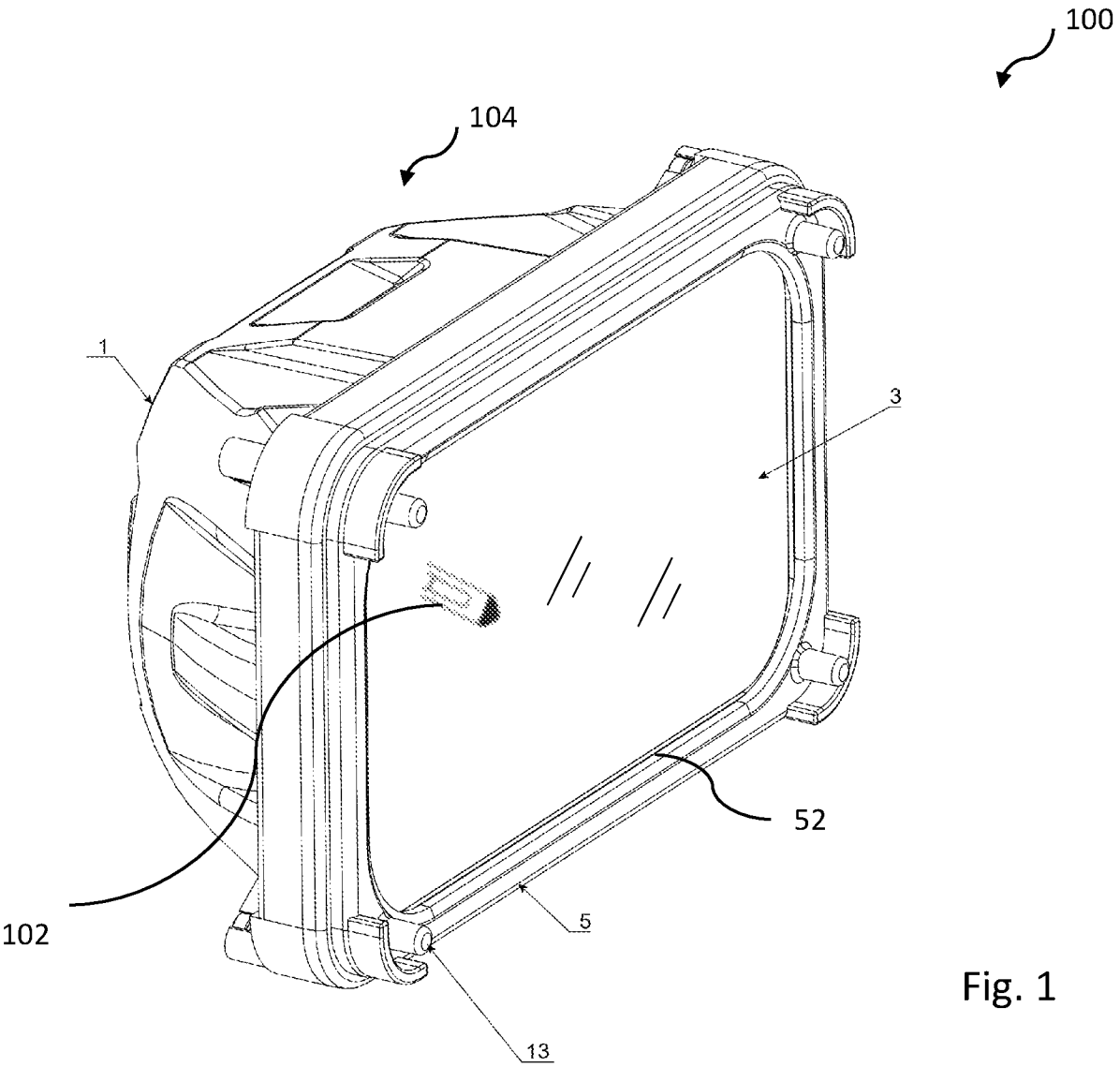
FIG. 1 is a schematic perspective view of a vehicle headlight assembly according to one embodiment of the present disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

The present disclosure relates to apparatus and methods for heating a lens for a light source. More particularly, the present disclosure relates to a heating unit for use in a vehicle light, methods of installation and control systems for the heating unit.

In some embodiments, a heating unit according to the present disclosure includes a connector configured to maintain an electronic connection between a heating element and a control circuit by a bias force, such as a spring force. Instead of forming a fixed attachment with the heating element, the connector is pushed against the heating element to maintain connection therebetween. The non-fixed contact to the heater provides reliability, flexibility and simplicity to the heating unit.

In some embodiments, a heating unit according to the present disclosure includes a sensor disposed near the lens but not in direct contact with the lens to enable reliable automatic operation of the heating unit.

Figure 2:
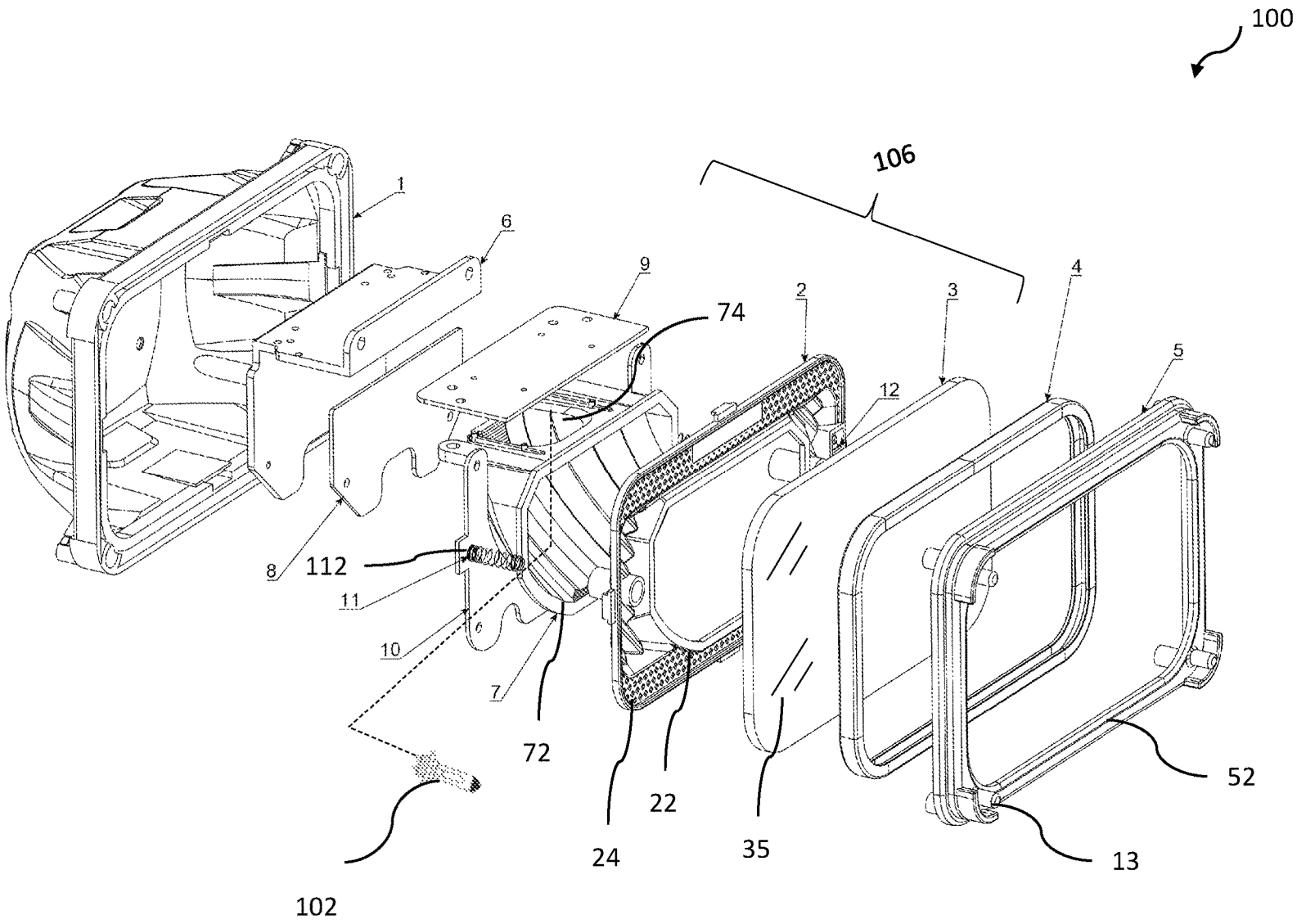
FIG. 2 is a schematic exploded view of the vehicle headlight assembly of FIG. 1.
Figure 3:
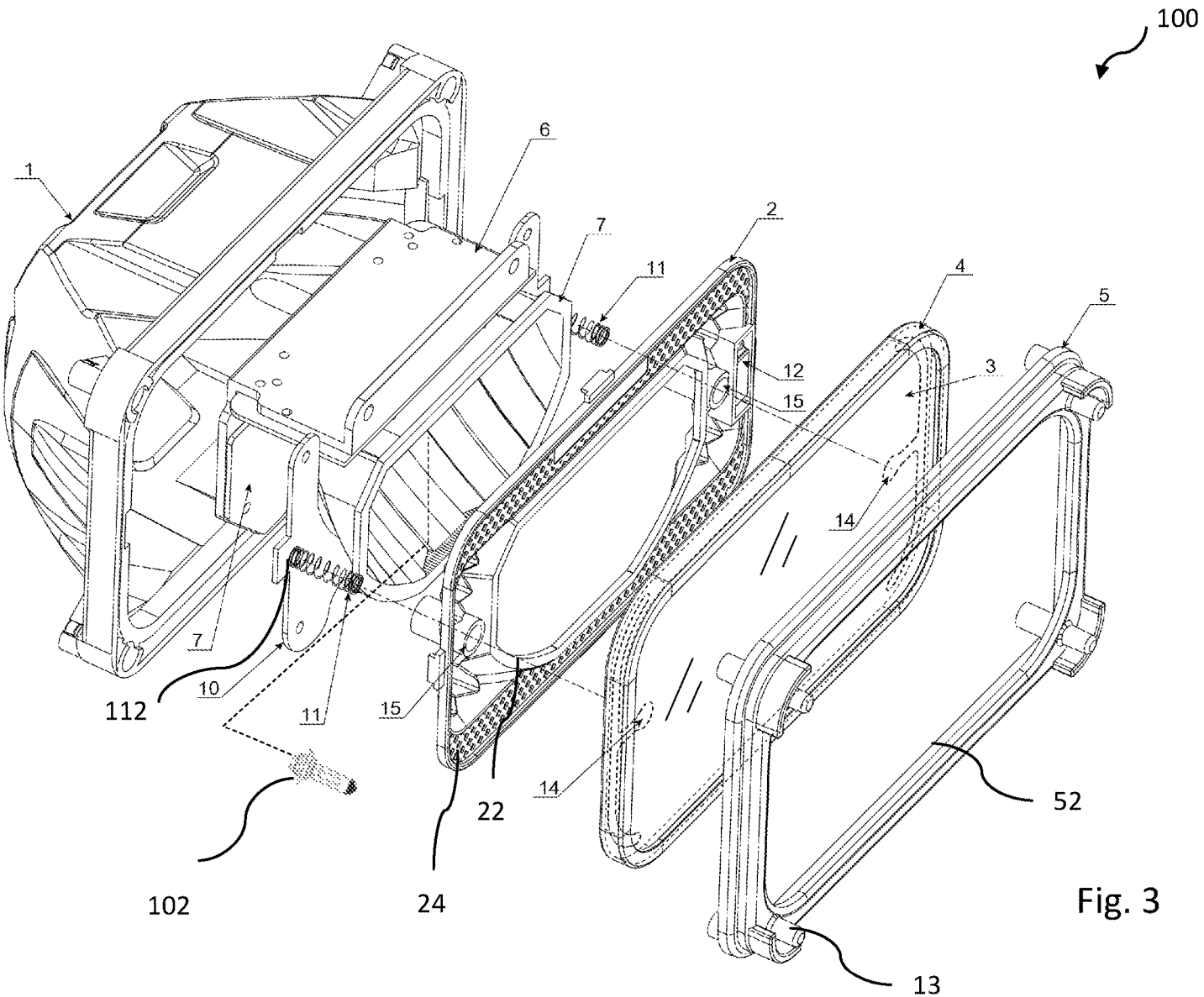
FIG. 3 is a schematic exploded view the vehicle headlight assembly of FIG. 1 partially assembled.

FIG. 1 is a schematic perspective view of a vehicle headlight assembly 100 according to one embodiment of the present disclosure. FIG. 2 is a schematic exploded view of the vehicle headlight assembly 100. FIG. 3 is a schematic exploded view the vehicle headlight assembly 100 partially assembled.

The vehicle headlight assembly 100 includes a light source 102 disposed inside a housing 104. The light source 102 may be any suitable light source, such as a LED light, a halogen lamp, a xenon lamp, a laser light, or the like. The light source 102 may be interchangeable. In some embodiments, the light source 102 may be an independent light bulb that is plugged in to the vehicle headlight assembly 100. In other embodiments, the light source 102 may be a printed circuit board including one or more LED modules.

The housing 104 includes a rear case 1 and a front case 5. The front case 5 has an opening 52. A transparent window 3 is disposed in the opening 52 of the front case 5. The light source 102 is positioned to radiate light beams through the transparent window 3. The transparent window 3 may be formed to function as a lens to direct light beams transmitted therethrough towards a target direction and a distance. The transparent window 3 has an outer surface 35 facing the exterior of the vehicle headlight assembly 100 and an inner surface 36 facing the light source 102. In some embodiments, the transparent window 3 is made of tempered glass. Alternatively, the transparent window 3 may be made of other optically transparent materials. For example, the transparent window 3 may be formed from a transparent polymer, such as polycarbonate (PC), PMMA, polyethylene terephthalate (PET), and the like.

According to embodiments of the present disclosure, the transparent window 3 is selectively heated to prevent condensation and/or ice formed thereon. In some embodiments, the transparent window 3 is heated by a heater positioned nearby or directly attached to the inner surface 36 of the transparent window 3. In one embodiment, a conductive film is formed over the transparent window 3 to evenly heat the transparent window 3.

The front case 5 and the rare case 1 may be snapped together to form the housing 104. In some embodiment, supporting columns 13 are used to installation. A sealing ring 4 may be disposed around the transparent window 3. The sealing ring 4 and the transparent window 3 are disposed in the opening 52 of the front case 5 to enclose an inner volume in the housing 104.

In some embodiments, the vehicle headlight assembly 100 includes a front cover 2 and a reflective cup 7. The reflective cup 7 includes a reflective surface 72 shaped to perform desired optical functions. The reflective cup 7 may be formed from metal, plastic, glass, or any suitable material. When assembled, the light source 102 may be disposed in the reflective cup 7 so that light beams from the light source 102 are reflected one or more times by the reflective surface 72, then projected out through the transparent window 3.

Even though one reflective cup 7 is shown in FIGS. 1-3, the vehicle headlight assembly 100 may include two or more reflective cups 7 and two or more light sources 102.

The front cover 2 may be an opaque plate having an opening 22 shaped similar to the reflective cup 7. When assembled, the front cover 2 is placed against the transparent window 3 to cover areas outside the reflective cup 7. In some embodiments, the front cover 2 may include decorative features 24 around the opening 22.

In some embodiments, the vehicle headlight assembly 100 includes a control unit 9 connected to the light source 102. The control unit 9 is configured to provide electrical power to the light source 102 and to control the operating status of the light source 102. In some embodiments, the control unit 9 may include a printed circuit board (PCB) having control circuit and interfaces for light sources and power supply. In some embodiments, as shown in FIG. 2, the control unit 9 may include one or more light source interfaces so that the light source 102 can be interchangeably plugged in.

In other embodiments, the light source 102 may be integrated on the PCB of the control unit 9. For example, the light source 102 may be one or more LED modules on the control unit 9. In some embodiments, the PCB of the control unit 9 may be attached to the reflective cup 7. The reflective cup 7 may include a light source opening 74 for the light source 102 to project light beams towards the reflective surface 72 on the reflective cup 7. In some embodiments, the control unit 9 may be fixedly attached to the reflective cup 7.

In some embodiments, the vehicle headlight assembly 100 further includes a radiator 6. The radiator 6 is configured to enhance heat dissipation around the light source 102. In some embodiments, the radiator 6 is attached to the reflective cup 7.

In some embodiments, the vehicle headlight assembly 100 further includes a heating unit 106 configured to heat the transparent window 3 during operation. In some embodiments, the heating unit 106 includes a heating controller 10, one or more heating connectors 11, and a heater 34. In some embodiments, the heating unit 106 further includes a temperature sensor 12.

Figure 4:
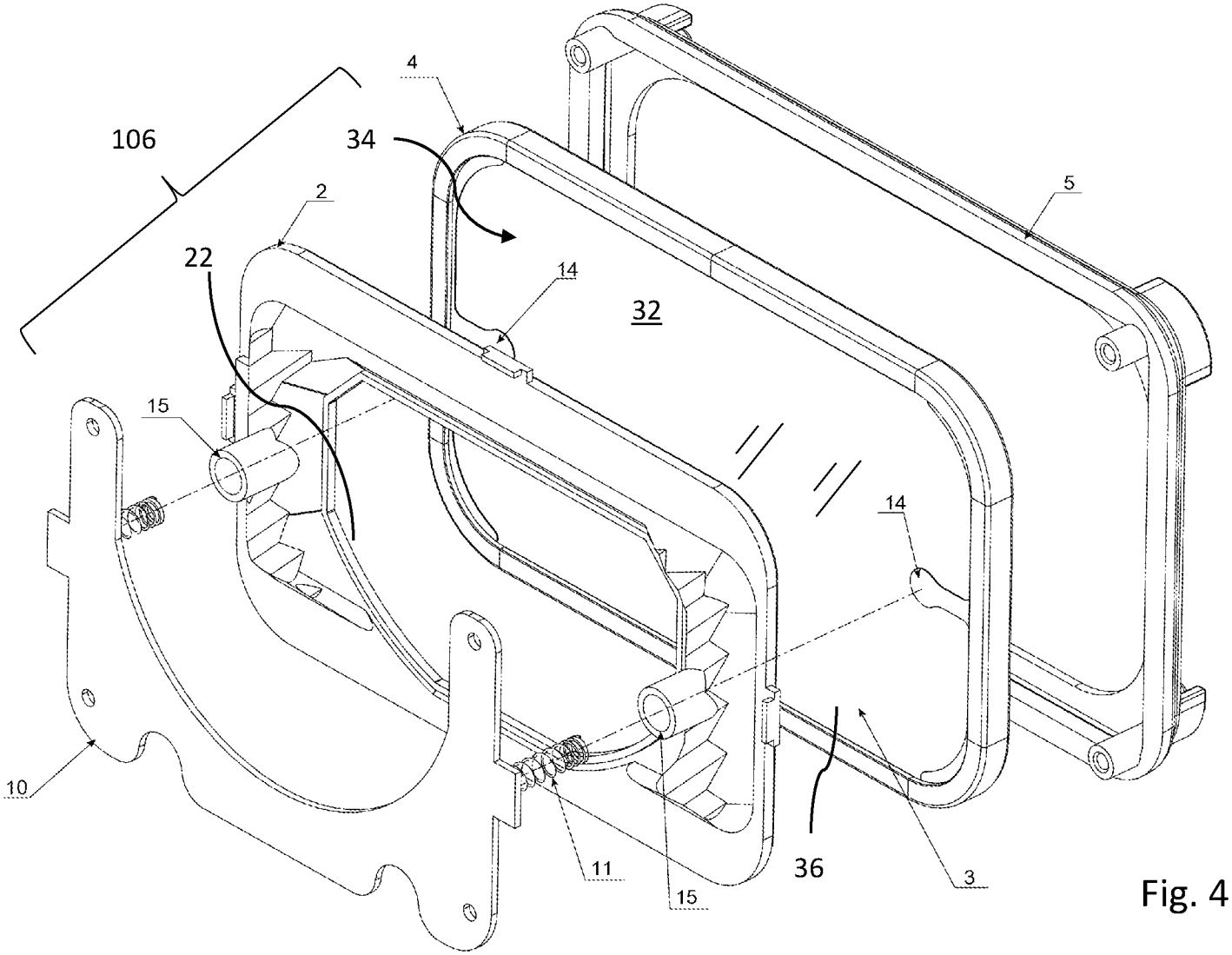
FIG. 4 is a schematic partial exploded view of the vehicle headlight assembly of FIG. 1 showing a heating unit.
Figure 5:
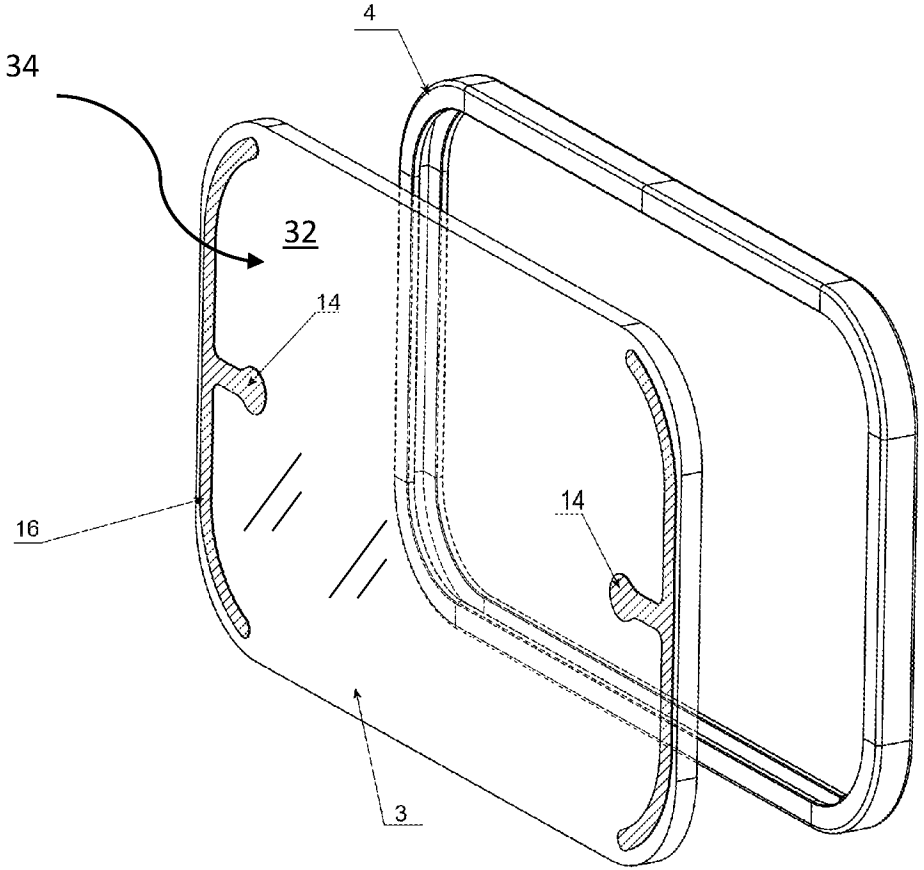
FIG. 5 is a schematic perspective view of a transparent window having a heating element according to embodiments of the present disclosure.

FIG. 4 is a schematic partial exploded view of the vehicle headlight assembly 100 showing components of the heating unit 106 according to one embodiment of the present disclosure. FIG. 5 is a schematic perspective view of the transparent window 3 showing the heater 34 according to embodiments of the present disclosure.

In some embodiments, the heater 34 is a resistive heater attached to the inner surface 36 of the transparent window 3. In some embodiments, the heater 34 includes a transparent conductive film 32 disposed over the inner surface 36 of the transparent window 3, and two contact pads 16 attached to the conductive film 32 near an edge region of the transparent window 3.

The transparent conductive film 32 may be formed over the entire inner surface 36 of the transparent window 3. The transparent conductive film 32 may function as a resistive heater that generates heat while electrical current passes through to heat the transparent window 3. In some embodiments, the transparent conductive film 32 may be formed over the transparent window 3 by electroplating. Alternatively, the transparent conductive film 32 may be formed on to the transparent window 3 by other suitable means, such as spray coating, or attached by adhesive.

The contact pads 16 may be formed over the transparent conductive film 32 to provide electrical connection between the conductive film 32 and a power supply. In some embodiments, the contact pads 16 are formed over areas that are outside the area corresponding to the opening 22 so that the contact pads 16 do not affect light transmission of the transparent window 3. As shown in FIG. 5, the contact pads 16 may be formed symmetrically along two edges of the transparent window 3. Each of the contact pads 16 may be an elongated belt along a width of the transparent window 3 to provide even and sufficient contract areas with the transparent conductive film 32. In some embodiment, the contact pads 16 may be formed from an electrical conductor, such as silver, copper, aluminum, or the like. In some embodiments, the contact pads 16 may be covered with a protective coating to avoid physical and/or chemical damage from the external environment.

In some embodiment, the contact pads 16 and the transparent conductive film 32 may be arranged so that the electric resistance between the contact pads 16 is a target resistance for properly heating the transparent window 3. In some embodiments, the target electrical resistance is between about 20 ohms to about 60 ohms. Alternatively, the target electrical resistance is determined according to surface area of the transparent window 3.

In some embodiments, each contact pad 16 includes an electrode area 14 for establishing an electrical contact with a power supply and/or control circuit. In one embodiment, the electrode area 14 may be an exposed area on the contact pads 16. The electrode area 14 may be large enough to tolerant relative movement of components due to temperature variation to maintain an electrical contact. In some embodiments, the electrode area 14 may be circular area positioned near a middle section of the corresponding contact pad 16. The electrode area 14 is configured to establish an electrical connection with a connector, such as the connector 11, by a non-fixed connection. The non-fixed connection provides flexibility in the electrical connection and enable connections when components move relatively during operation, for example, relative movements caused by different thermal expansion among different components.

Alternatively, other type of heaters may be used in place of the heater 34 to heat the transparent window 3, for example a transparent film heater.

In some embodiments of the present disclosure, the heating controller 10 includes one or more a printed circuit board (PCB) disposed within the housing 104, for example in the inner volume of the housing 104 around the reflective cup 7. In some embodiments, the heating controller 10 may include a processor, memory, one or more input ports, one or more output ports, and circuitry configured to operate the heater 34 and the temperature sensor 12.

In some embodiments, the heating controller 10 includes electrodes 112 for connecting with the heater 34 through the connectors 11. The electrodes 112 are formed on the PCB of the heating controller 10 to provide a power supply to the heater 34. According to embodiments of the present disclosure, the connectors 11 are connected to the electrodes 112 on the controller through a non-fixed connection. In some embodiments, the heating unit 106 includes two connectors 11 configured to contact the two electrode areas 16 on the heater 34. When the connectors 11 are in contact with the electrode areas 16, a voltage potential from a power supply may be applied across the conductive film 32 and the current through the conductive film 32 generates heat to heat the transparent window 3.

According to embodiments of the present disclosure, the connectors 11 are spring components formed from an electrically conductive material. The connectors 11 are positioned between the heater 34 and the controller 10 under pre-loaded force and the spring force of the connectors 11 maintains the electrical connections between the controller 10 and the heater 34.

Figure 6:
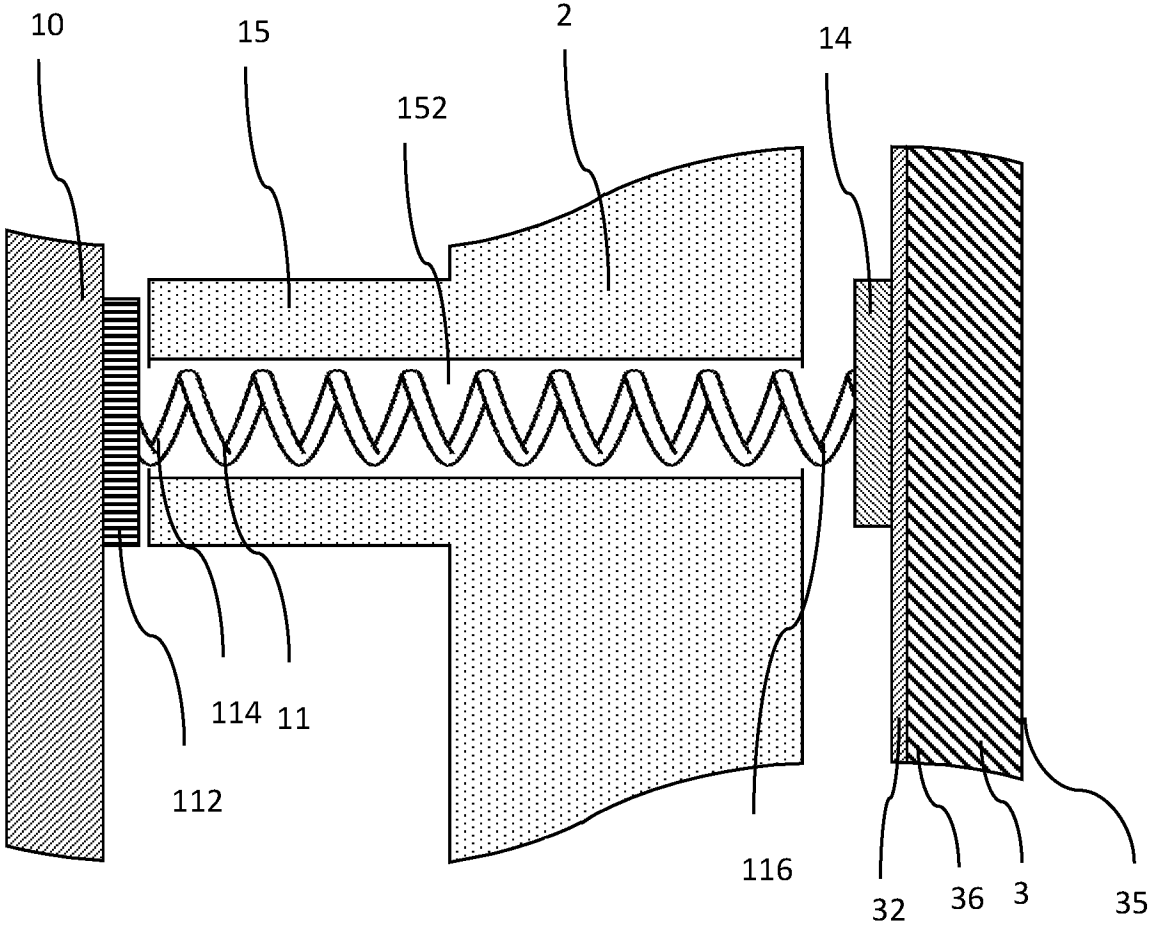
FIG. 6 is a schematic partial sectional view of the vehicle headlight assembly showing a pre-loaded connection to a heating element.

FIG. 6 is a schematic partial sectional view of the vehicle headlight assembly 100 showing a pre-loaded connection between the heating controller 10 and the heater 34. As shown in FIG. 6, the connector 11 is a helical compression spring. When assembled, the connector 11 is under compression having a first end 114 in contact with the electrode 112 on the controller 10 and a second end 116 in contact with the electrode area 14 of the heater 34. The connections at the ends 114, 116 are maintained by springing force from the connectors 11. In some embodiments, the front cover 2 may include guideposts 15 having guide tunnels 152 for housing the connectors 11. When the connector 11 is a helical spring as shown in FIG. 6, the guide tunnel 152 is a linear channel to ensure that the helical spring does not bend under compression. The guide tunnels 152 may have other shapes when the connectors 11 are made of different type of springs.

In some embodiments, the first end 114 of the connector 11 may be fixedly attached to the controller 9.

Even though a helical spring is shown in FIG. 6, the connectors 11 may be any suitable structure capable of loading the connection with a force. For example, the connectors 11 may be coil springs, leaf springs, torsion springs, spring clips, bevel springs, or the like.

In some embodiments of the present disclosure, the temperature sensor 12 may be used to measure temperature and enable automatic control of the heater 34. The temperature sensor 12 may be positioned near the transparent window 3 but not in direct contact with the transparent window 3. The temperature sensor 12 is connected to the heating controller 10. The heating controller 10 receives temperature measurements from the temperature sensor 12 and activate or deactivate the heater 34 accordingly. In some embodiments, the heating controller 10 may include a switch in the circuit for supplying electrical power to the heater 34. The switch may be turned on and off according to the readings of the temperature sensor 12. In some embodiments, the switch may be integrated with the temperature sensor 12. The switch is configured to switch off when the temperature measurement reaches a predetermined off-value, and to switch on when the temperature measurement reaches a predetermined on-value.

Figure 7:
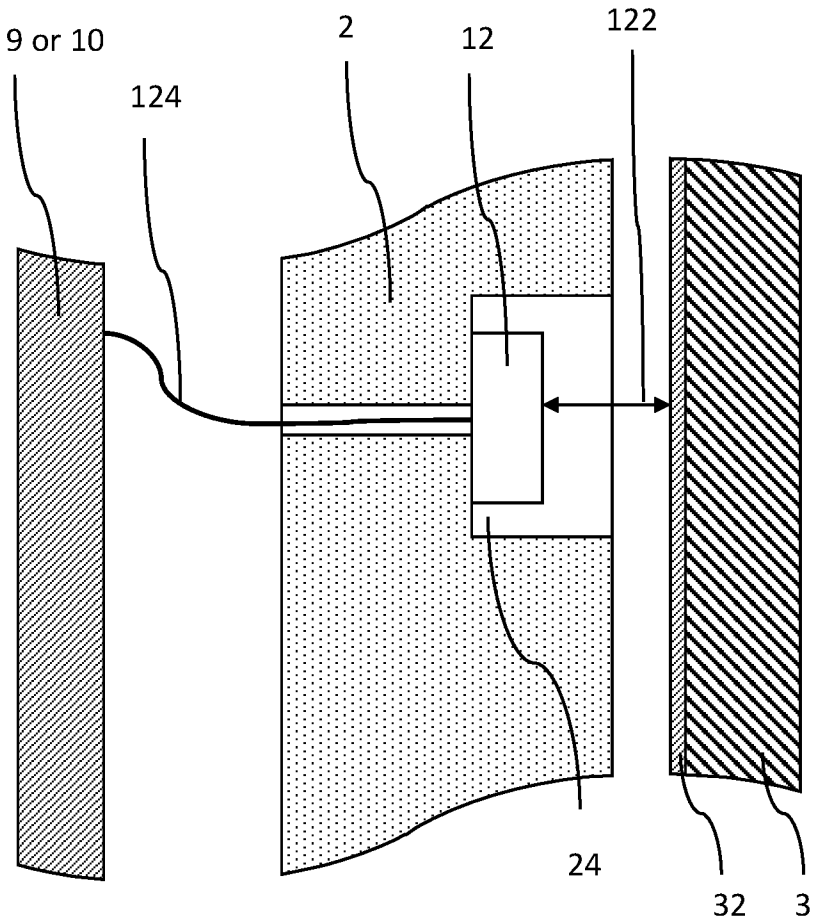
FIG. 7 is a schematic partial sectional view of the vehicle headlight assembly showing a temperature sensor.

FIG. 7 is a schematic partial sectional view of the vehicle headlight assembly 100 showing the temperature sensor 12. The temperature sensor 12 may be placed in a cavity 24 in the front cover 2. The temperature sensor 12 may be connected to the heating controller 10 by lines 124. A gap 122 exists between the temperature sensor 12 and the transparent window 3. The gap 122 ensures that the temperature sensor 12 is not in direct contact with the transparent window 3 so that the temperature sensor 12 measures heat induction from the transparent window 3. The non-contact measurement by the temperature sensor 12 improves stability and effectiveness of the heat controller 9.

In some embodiment, the switch attached to the temperature sensor 12 may be switched off when induction temperature measurement of the temperature sensor 12 reaches an off-temperature to turn off the power supply to the heater 34, and switched on when induction temperature measurement of the temperature sensor 12 reaches an on-temperature to turn on the power supply to the heater 34. In some embodiments, the off-temperature is between about 45° C. to about 55° C., and the on-temperature is between about 30° C. and about 40° C.

In some embodiments, the temperature sensor 12 is also used to provide automatic control to of the light source 102. The temperature sensor 12 may be connected to the controller 9 that is used to control the light source 102. Using the heating function of the heater 34 may be activated at the same time with the light source 102.

Figure 8:
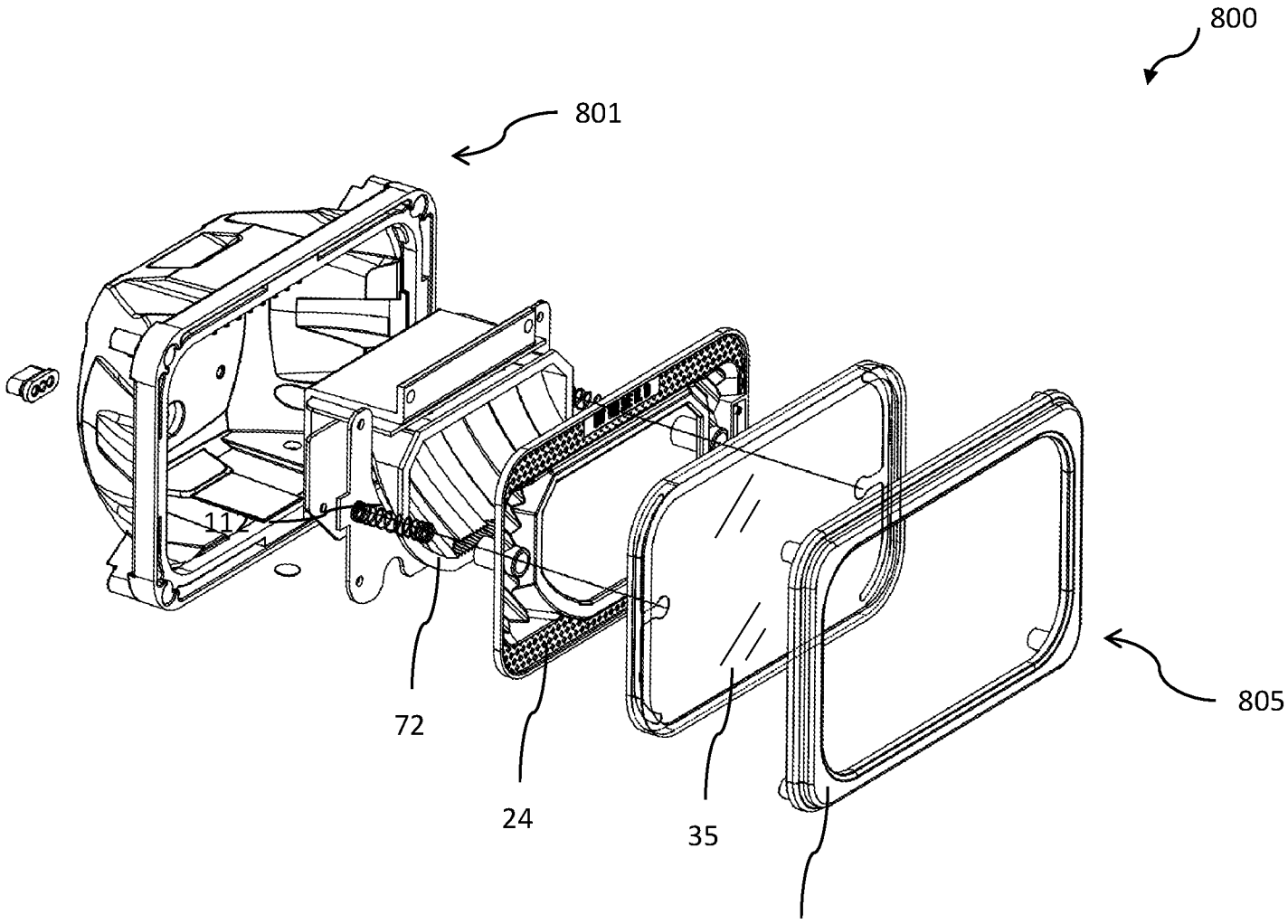
FIG. 8 is a schematic perspective view of a vehicle headlight assembly according to another embodiment of the present disclosure.

FIG. 8 is a schematic perspective view of a vehicle headlight assembly 800 according to another embodiment of the present disclosure. The vehicle headlight assembly 800 is similar to the vehicle headlight assembly 100 except that the vehicle headlight assembly 800 includes a rear case 801 and a front case 805 that are different from the rear case and front case 5 of the vehicle headlight assembly 100. When assembled, the front case 805 and the rear case 801 are secured together without using any supporting columns, such as the supporting columns 13 protruding from the front case 5 of the vehicle headlight assembly 100. As a result, the front case 805 has a flat front surface 850, which provides an alternative design choice.

Even though a vehicle light assembly is described above, embodiments of the present invention may be used to heat lenses for any light sources. For example, embodiments of the present invention may be used to heat the lens of outdoor lighting, such as street lights, stadium lights, stage lights, and the like.

Embodiments of the present disclosure provide apparatus and methods for heating a lens of a light source, such as a vehicle headlight. Using thermal conductivity technology of electro lemma, the heating unit according to the present disclosure can help melt snow and ice over the light source. By attaching a thermal conductive film to a transparent window of a light source, and powering electrodes on both sides of the thermal conductive film, the transparent window of the light source is heated through the transparent electric-conduction film. This heating mechanism ensures that the headlights of the automobile can provide effective and safe lighting in winter or extremely cold areas and when the light condition is poor.

By adopting temperature protection switch to control the heating system, the heating unit according to the present disclosure reduces human error in operation, ensures stable function and timely activation, reduces energy consumption, prevents overheating, and improves safety to use.

By positioning a temperature sensor adjacent to but not in direct contact with a transparent window in a light assembly, embodiments of the present disclosure provide stable and effective temperature control to the light assembly.

According to embodiments of the present disclosure, conductive terminals/contact areas between electrode interface of the transparent conductive film and the control unit are connected with springs. The non-fixed connection provides flexibility and simplifies the matching accuracy. It also reduces the use of conductors, simplifies the structure, facilitates the simplicity of coordination and installation, saves energy and protects the environment Embodiments of the present disclosure provide a heating unit for a light assembly. The light assembly includes a heating element attached to a transparent window and configured to heat the transparent window, a controller configured to provide electrical power to the heating element, and a connector having a first end in contact with the heating element and a second end in connection with the controller, wherein the first end contacts the heating element under a pre-loaded force.

In one or more embodiments, the connector comprises a spring.

In one or more embodiments, the connector comprises a compression spring.

In one or more embodiments, the controller includes a printed circuit board (PCB), an electrode is formed on the PCB, and the second end of the connector contacts the electrode under a pre-loaded force.

In one or more embodiments, the heating element comprises a transparent conductive film attached to the transparent windows, and two contact pads formed on the transparent conductive film on edge regions of the transparent conductive film, wherein each contact pad includes an electrode area for contacting with the connector.

In one or more embodiments, a resistance between the two contact pads is between about 20 ohms to about 60 ohms.

In one or more embodiments, the light assembly further includes a temperature sensor connected to the controller.

In one or more embodiments, the temperature sensor is positioned adjacent to the transparent window but not in contact with the transparent window to measure induction temperature of the transparent window.

In one or more embodiments, the temperature sensor is connected to a protective switch, and the protective switch is configured to switch on when temperature measurement of the temperature sensor reaches an on-value and to switch off when the temperature measurement of the temperature sensor reaches an off-value.

In one or more embodiments, the on-value is between about 45° C. to about 45° C., and the off-value is between about 30° C. to about 40° C.

In one or more embodiments, the protective switch is configured to turn on the heating element and a light source at the same time.

Some embodiments of the present disclosure provide a heating unit for a light assembly. The heating unit includes a heating element attached to a transparent window and configured to heat the transparent window, a controller configured to provide electrical power to the heating element, and a temperature sensor connected to the controller, wherein the temperature sensor is positioned adjacent to the transparent window but not in contact with the transparent window to measure induction temperature of the transparent window.

In one or more embodiments, the temperature sensor is connected to a protective switch, and the protective switch is configured to switch on when temperature measurement of the temperature sensor reaches an on-value and to switch off when the temperature measurement of the temperature sensor reaches an off-value.

In one or more embodiments, the on-value is between about 45° C. to about 45° C., and the off-value is between about 30° C. to about 40° C.

Some embodiments of the present disclosure provide a vehicle headlight assembly. The vehicle headlight assembly includes a housing defining an inner volume and having an opening, a transparent window disposed in the opening, a heating unit disposed in the inner volume, wherein the heating unit comprises a heating element attached to the transparent window, a controller configured to provide electrical power to the heating element, and a connector disposed between the controller and the heating element, wherein the connector contacts the heating element by a non-fixed connection.

In one or more embodiments, the vehicle headlight assembly further includes a temperature sensor disposed adjacent the transparent window and configured to measure induction temperature of the transparent window.

In one or more embodiments, the connector is a compression spring.

In one or more embodiments, the vehicle headlight assembly further includes a front cover disposed in the inner volume next to the transparent window, wherein the front cover includes a guide post having a guide tunnel, and the compression spring is disposed in the guide tunnel.

In one or more embodiments, the front cover further includes a cavity, and a temperature sensor is in the cavity to measure induction temperature of the transparent window.

In one or more embodiments, the heating unit comprises a transparent conductive film attached to the transparent windows, and two contact pads formed on the transparent conductive film on edge regions of the transparent conductive film, wherein the connector includes two compression springs, and each contact pad includes an electrode area for contacting with a corresponding compression screen.

While the foregoing is directed to embodiments of the present disclosure, other and further embodiments of the disclosure may be devised without departing from the basic scope thereof.

The invention claimed is:

1. A heating unit for a light assembly, comprising:

a heating element attached to a transparent window and configured to heat the transparent window;

a controller configured to provide electrical power to the heating element; and a connector having a first end in contact with the heating element and a second end in connection with the controller, wherein the first end contacts the heating element under a pre-loaded force, wherein the heating element comprises:

a transparent conductive film attached to the transparent window and covers an inner surface of the transparent window; and two contact pads formed on the transparent conductive film on edge regions of the transparent conductive film, wherein each contact pad includes an electrode area for contacting with the connector, each of the contact pads includes an elongated belt extending along a width of the transparent window, and the two contact pads are disposed symmetrically on opposing edges of the transparent window.

2. The heating unit of claim 1, wherein the connector comprises a spring.

3. The heating unit of claim 2, wherein the connector comprises a compression spring.

4. The heating unit of claim 1, wherein the controller includes a printed circuit board (PCB), an electrode is formed on the PCB, and the second end of the connector contacts the electrode under a pre-loaded force.

5. The heating unit of claim 1, wherein a resistance between the two contact pads is between about 20 ohms to about 60 ohms.

6. The heating unit of claim 1, further comprising a temperature sensor connected to the controller.

7. The heating unit of claim 6, wherein the temperature sensor is positioned adjacent to the transparent window but not in contact with the transparent window to measure induction temperature of the transparent window.

8. The heating unit of claim 7, wherein the temperature sensor is connected to a protective switch, and the protective switch is configured to switch on when temperature measurement of the temperature sensor reaches an on-value and to switch off when the temperature measurement of the temperature sensor reaches an off-value.

9. The heating unit of claim 8, wherein the off-value is between about 45° C. to about 55° C., and the on-value is between about 30° C. to about 40° C.

10. The heating unit of claim 8, wherein the protective switch is configured to turn on the heating element and a light source at the same time.

11. A heating unit for a light assembly, comprising:

a housing having an opening;

a transparent window disposed in the opening;

a heating element attached to the transparent window and configured to heat the transparent window, wherein the heating element comprises:

a transparent conductive film attached to the transparent window and covers an inner surface of the transparent window; and two contact pads formed on the transparent conductive film on edge regions of the transparent conductive film, wherein each contact pad includes an electrode area for contacting with the connector, each of the contact pads includes an elongated belt extending along a width of the transparent window, and the two contact pads are disposed symmetrically on opposing edges of the transparent window;

a controller configured to provide electrical power to the heating element; and a temperature sensor connected to the controller, wherein the temperature sensor is positioned adjacent to the transparent window but not in contact with the transparent window to measure induction temperature of the transparent window, the temperature sensor is positioned in a cavity in the housing, and a gap exists between the temperature sensor and the transparent window.

12. The heating unit of claim 11, wherein the temperature sensor is connected to a protective switch, and the protective switch is configured to switch on when temperature measurement of the temperature sensor reaches an on-value and to switch off when the temperature measurement of the temperature sensor reaches an off-value.

13. The heating unit of claim 12, wherein the off-value is between about 45° C. to about 55° C., and the on-value is between about 30° C. to about 40° C.

14. A vehicle headlight assembly, comprising:

a housing defining an inner volume and having an opening;

a transparent window disposed in the opening;

a heating unit disposed in the inner volume, wherein the heating unit comprises:

a heating element attached to the transparent window;

a controller configured to provide electrical power to the heating element; and a connector disposed between the controller and the heating element, wherein the connector contacts the heating element by a non-fixed connection, wherein the heating element comprises:

a transparent conductive film attached to the transparent window and covers an inner surface of the transparent window; and two contact pads formed on the transparent conductive film on edge regions of the transparent conductive film, wherein each contact pad includes an electrode area for contacting with the connector, each of the contact pads includes an elongated belt extending along a width of the transparent window, and the two contact pads are disposed symmetrically on opposing edges of the transparent window.

15. The vehicle headlight assembly of claim 14, further comprising:

a temperature sensor disposed adjacent the transparent window and configured to measure induction temperature of the transparent window.

16. The vehicle headlight assembly of claim 14, wherein the connector is a compression spring.

17. The vehicle headlight assembly of claim 16, further comprising a front cover disposed in the inner volume next to the transparent window, wherein the front cover includes a guide post having a guide tunnel, and the compression spring is disposed in the guide tunnel.

18. The vehicle headlight assembly of claim 17, wherein the front cover further includes a cavity, and a temperature sensor is in the cavity to measure induction temperature of the transparent window.

19. The vehicle headlight assembly of claim 14, wherein the connector includes two compression springs for contacting with the electrode area of each contact pad.

20. The vehicle headlight assembly of claim 18, wherein a gap exists between the temperature sensor and the transparent window so that the temperature sensor measure induction temperature of the transparent window.

* * * * *